US012611587B1

(12) United States Patent
Achenbach et al.

(10) Patent No.: US 12,611,587 B1
(45) Date of Patent: Apr. 28, 2026

(54) BINDING SAFETY RELEASE DEVICE

(71) Applicant: Kenneth John Achenbach, Whistler (CA)

(72) Inventors: Kenneth John Achenbach, Whistler (CA); Justin Michel Lamoureux, Garibaldi Highlands (CA)

(73) Assignee: Kenneth John Achenbach, Whistler (CA)

( * ) Notice: Subject to any disclaimer, the term of this patent is extended or adjusted under 35 U.S.C. 154(b) by 0 days.

(21) Appl. No.: 19/375,967

(22) Filed: Oct. 31, 2025

Related U.S. Application Data

(60) Division of application No. 19/294,791, filed on Aug. 8, 2025, which is a continuation-in-part of application No. 19/207,013, filed on May 13, 2025.

(51) Int. Cl.
*A63C 10/28* (2012.01)

(52) U.S. Cl.
CPC ..... *A63C 10/28* (2013.01)

(58) Field of Classification Search
CPC ..... A63C 10/28; A63C 10/24; A63C 10/045; A63C 10/06
See application file for complete search history.

(56) References Cited

U.S. PATENT DOCUMENTS 5,362,087 A * 11/1994 Agid ..... A63C 10/145 280/14.22
5,556,123 A * 9/1996 Fournier ..... A63C 10/06 280/607
5,697,631 A * 12/1997 Ratzek ..... A63C 10/08 280/613
5,762,358 A * 6/1998 Hale ..... A63C 10/18 280/607
5,820,155 A * 10/1998 Brisco ..... A63C 10/12 280/607
6,024,375 A * 2/2000 Johnson ..... A63C 10/04 280/611
6,116,634 A * 9/2000 Mometti ..... A63C 10/04 280/616

(Continued)

FOREIGN PATENT DOCUMENTS

AT 515203 B1 * 7/2015 ..... A63C 10/24
EP 2692397 A1 * 2/2014 ..... A63C 10/24

(Continued)

*Primary Examiner* — James A Shriver, II
*Assistant Examiner* — Ian Bryce Shelton
(74) *Attorney, Agent, or Firm* — PATENTFILE, LLC; Bradley C. Fach; Steven R. Kick

(57) ABSTRACT

A binding safety release device may include a pivot lever having a first end, a second end, and one or more pivot points. Preferably, a first pivot point may be positioned between the first end and the second end. The device may include an elongated connector that may be coupled to the pivot lever between the first end and the second end. A handle may be coupled to the elongated connector so that the handle and pivot lever are coupled to opposite ends of the elongated connector. The pivot lever may be coupled to a binding release mechanism at the first pivot point so that movement of the pivot lever may be transferred to the binding release mechanism, such as to cause the binding release mechanism to release.

18 Claims, 17 Drawing Sheets

(56) References Cited

U.S. PATENT DOCUMENTS 6,276,708 B1 * 8/2001 Hogstedt ..... A63C 10/005
280/14.22
6,336,650 B1 * 1/2002 Alspaugh ..... A63C 10/20
280/613
7,134,928 B1 * 11/2006 Cannon ..... B63B 32/35
280/608
7,147,233 B2 * 12/2006 Edmond ..... A63C 10/06
280/14.22
7,232,132 B2 * 6/2007 Elkington ..... A63C 10/06
280/11.33
7,246,811 B2 * 7/2007 Martin ..... A63C 10/06
280/14.22
8,684,394 B2 * 4/2014 Smith ..... A63C 10/28
280/14.22
8,857,845 B2 * 10/2014 Ohlheiser ..... A63C 10/24
280/611
9,895,597 B2 * 2/2018 Suda ..... A63C 7/1066
10,105,588 B1 * 10/2018 Massey ..... A63C 10/045
2001/0010422 A1 * 8/2001 Merino ..... A63C 10/10
280/607
2005/0285372 A1 * 12/2005 Edmond ..... A63C 10/04
280/617
2006/0244241 A1 * 11/2006 Martin ..... A63C 10/045
280/619
2007/0045989 A1 * 3/2007 Cunningham ..... A43C 11/1466
280/618
2008/0254692 A1 * 10/2008 Cannon ..... B63B 32/35
441/70
2011/0254251 A1 * 10/2011 Jung ..... A63C 10/24
280/617
2012/0292887 A1 * 11/2012 Ohlheiser ..... A63C 10/045
280/611
2013/0328288 A1 * 12/2013 Smith ..... A63C 10/28
280/617
2017/0209772 A1 * 7/2017 Suda ..... A63C 10/06
2019/0247736 A1 * 8/2019 Massey ..... A63C 10/06

FOREIGN PATENT DOCUMENTS

EP 3693065 A1 * 8/2020 ..... A63C 10/24
WO WO-9731687 A1 * 9/1997 ..... A63C 10/06
WO WO-2015046644 A1 * 4/2015 ..... A63C 10/045
WO WO-2015172169 A1 * 11/2015 ..... A63C 10/06

* cited by examiner

BINDING SAFETY RELEASE DEVICE

CROSS REFERENCE TO RELATED APPLICATIONS

This application is a divisional of U.S. Non-Provisional application Ser. No. 19/294,791, filed on Aug. 8, 2025, entitled "Binding Safety Release Device", which is a continuation-in-part of U.S. Non-Provisional application Ser. No. 19/207,013, filed on May 13, 2025, entitled "Binding Safety Release Device", which are hereby incorporated by reference in its entirety.

FIELD OF THE INVENTION

This patent specification relates to the field of safety devices for sports equipment. More specifically, this patent specification relates to a safety release device for use with foot binding sports equipment, such as snowboard bindings.

BACKGROUND

A wide variety of riding sports equipment exist for mountain snow sport enthusiasts. This equipment includes snowboards and downhill skis which include foot binding elements that are used to secure the boots of an individual to a snowboard or ski. For functional and safety reasons, snowboards also typically employ bindings that semi-permanently hold the snowboarders' boot to the board, forcing the rider to strap in and strap out of the bindings one or two feet when a rider wants to traverse flat or upward portions of the mountain or trail or when the rider has fallen and needs to release one or both bindings. Unfortunately, in the case of an emergency, and depending on the position of the rider, it may be difficult or impossible for the rider to reach their hand all the way to the safety lever release mechanism that is relatively proximate to the junction of the snowboard and binding. If the rider is unable to reach the safety lever release mechanism they may remain trapped in an uncomfortable or possibly even life-threatening position until another individual arrives to operate the safety lever release mechanism for them.

Therefore, a need exists for novel safety release devices for use with foot binding sports equipment.

BRIEF SUMMARY OF THE INVENTION

A binding safety release device is provided which may be used with and coupled to foot binding sports equipment, such as a snowboard binding. Optionally, the device may include a snowboard binding having a binding release mechanism. In some embodiments, the device may include a pivot lever having a first end and an opposingly positioned second end. The pivot lever may have one or more pivot points. An elongated connector may be coupled to the pivot lever, and a handle may be coupled to the elongated connector so that the handle and pivot lever are coupled to opposite ends of the elongated connector. Optionally, the device may include a snowboard binding having a highback and a binding release mechanism, and the first pivot point may be coupled to the binding release mechanism, such as with a pivot fastener.

In some embodiments, a binding safety release device may include a pivot lever having a first end, a second end, and a pivot point, and the pivot point may be positioned relatively closer to the second end than to the first end. An elongated connector may be coupled to the pivot lever between the first end and the pivot point; and a handle may be coupled to the elongated connector so that the handle and pivot lever are coupled to opposite ends of the elongated connector. Optionally, the device may further include a guide having a channel. A portion of the elongated connector may be positioned within the channel, and the guide may be coupled to a snowboard binding. The pivot lever may be coupled to a binding release mechanism of a snowboard binding so that movement of the pivot lever may be transferred to the binding release mechanism, such as to cause the binding release mechanism to release.

In some embodiments, the device may include a pivot lever having a first end, a second end, a first pivot point, and a second pivot point, and the first pivot point may be positioned relatively closer to the first end than the second pivot point is positioned to the first end so that the first pivot point is positioned between the first end and the second pivot point. An elongated connector may be coupled to the second pivot point via a pivotal coupling, and the second pivot point may be positioned between the first pivot point and the second end A handle may be coupled to the elongated connector so that the handle and pivot lever are coupled to opposite ends of the elongated connector. The pivot lever may be coupled to a binding release mechanism so that movement of the pivot lever may be transferred to the binding release mechanism, such as to cause the binding release mechanism to release.

Optionally, an elongated connector may have a fixed length. Optionally, an elongated connector may have an adjustable length. Optionally, an elongated connector may have an adjustable length. For example, the elongated connector may have a lower receiver and a threaded shaft that are movably coupled together, and the lower receiver may be coupled to the pivot lever via the pivotal coupling. The handle may be coupled to the threaded shaft, and the device may be movable between a first position and a second position. The handle may be relatively closer to the lower receiver when the device is in the first position, and the handle may be relatively farther from the lower receiver when the device is in the second position.

In some embodiments, a binding safety release device may include a pivot lever, a handle, and an elongated connector. The pivot lever may have a first end, a second end, and a first pivot point, and the first pivot point may be positioned proximate to the second end. The elongated connector may include a threaded shaft and a lower receiver that may have an upper end and a lower end. A pivotal coupling may be coupled to the pivot lever between the first pivot point and the first end, and the pivotal coupling may couple the lower end of the lower receiver to the pivot lever. The threaded shaft may be coupled to the lower receiver, and a handle may be coupled to the threaded shaft so that the handle and lower receiver are coupled to opposite ends of the threaded shaft.

Numerous objects, features and advantages of the present invention will be readily apparent to those of ordinary skill in the art. Some example objects of the present invention are listed below.

One object of the present invention is to provide a binding safety release device that is configured to enable users to have, in case of emergency, the ability to activate the release mechanism of StepON bindings and other foot binding sports equipment from a secondary position. If the user falls in an awkward position and is unable to reach and release the StepON binding release mechanism located at their ankle, the binding safety release device enables the user to release the binding by pulling on the handle from just below their knee, a lifesaving difference.

Another object is to provide a binding safety release device that may be configured to provide an Adjustable Length Binding Safety Release device having a lower receiver and/or a handle may be movably coupled to the elongated connector enabling the handle to be raised or lowered to fit any size StepON bindings and other foot binding sports equipment and to fit any users desired handle positioning.

Another object is to provide a binding safety release device that may be configured to replace the user's stock StepON binding release lever with a pivot lever of the present invention. The pivot lever can be used two ways. The first way is the traditional use method of leaning down and pulling the lever to activate the binding's release mechanism and the second way is a new way to activate the binding release mechanism by pulling the handle as it is positioned higher up the user's leg (e.g., positioned higher up on the snowboard binding to which the device is attached).

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
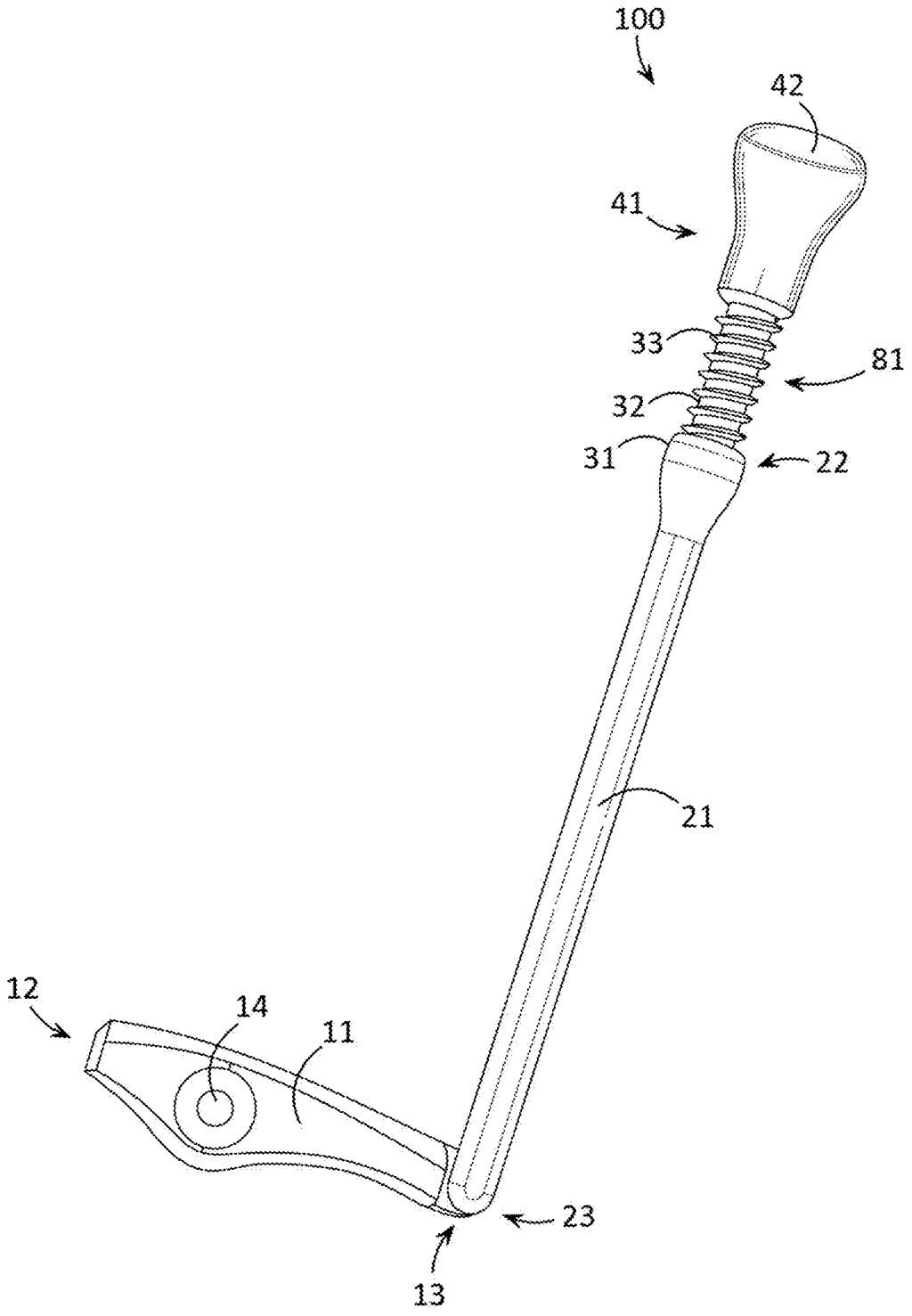
FIG. 1 depicts a front perspective view of an example of a binding safety release device in a first position according to various embodiments described herein.
Figure 2:
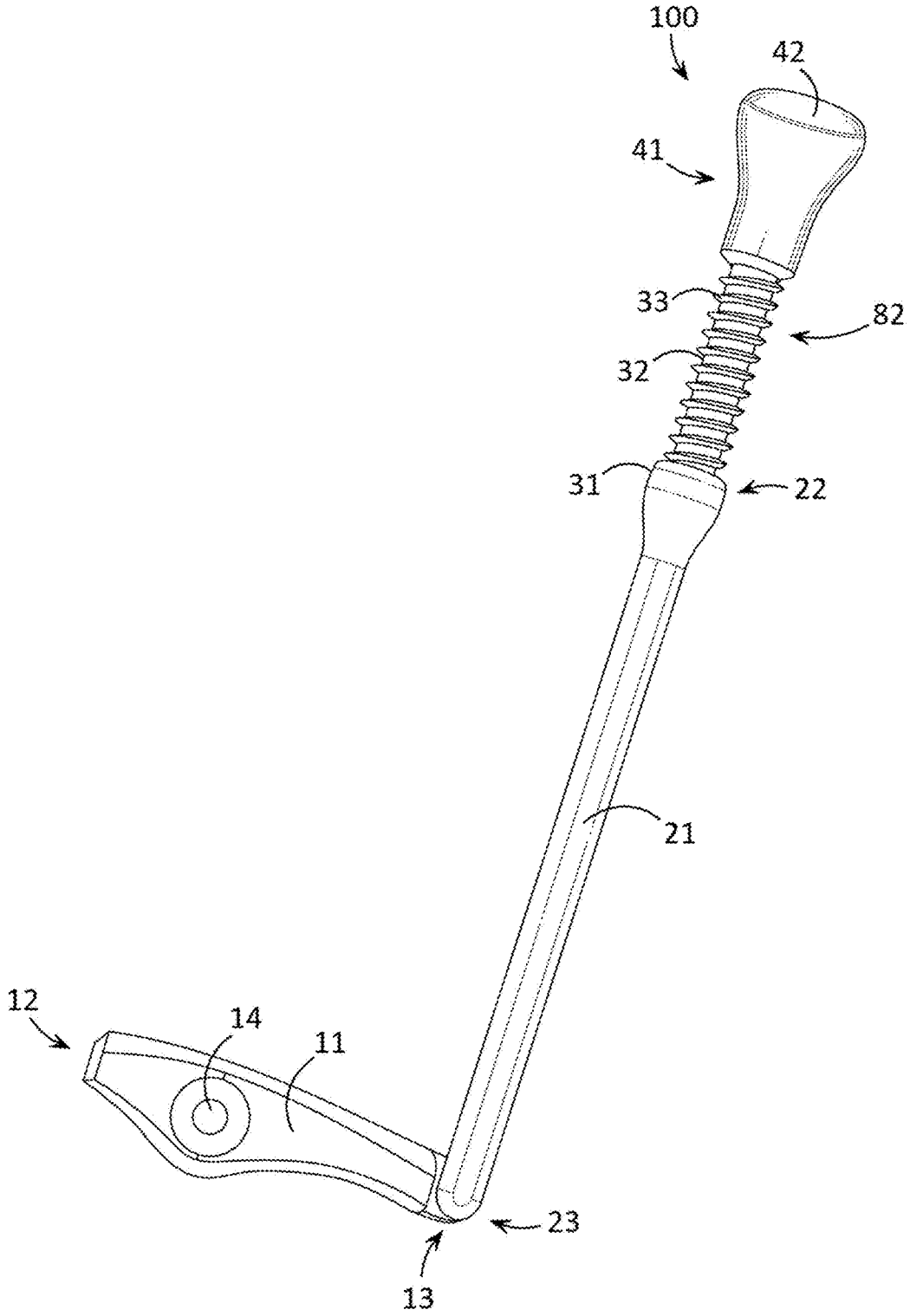
FIG. 2 illustrates a front perspective view of an example of a binding safety release device in a second position according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new binding safety release device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-3 and 5-16 illustrate examples of a binding safety release device ("the device") 100 according to various embodiments. In some embodiments, the device 100 may comprise a pivot lever 11 having a first end 12 and an opposingly positioned second end 13. The pivot lever 11 may comprise one or more pivot points 14, 15. An elongated connector 31 may be coupled to the pivot lever 11, and a handle 41 may be coupled to the elongated connector 31 so that the handle 41 and pivot lever 11 are coupled to opposite ends of the elongated connector 31. In further embodiments, the device 100 may comprise a snowboard binding 200 having a highback 202 and a binding release mechanism 201, and the first pivot point 14 may be coupled to the binding release mechanism 201, such as with a pivot fastener 16.

In some embodiments, and as shown in FIGS. 1-6, the device 100 may comprise a pivot lever 11 having a first end 12, a second end 13, a first pivot point 14, and a second pivot point 15, and the first pivot point 14 may be positioned relatively closer to the first end 12 than the second pivot point 15 is positioned to the first end 12 so that the first pivot point 14 is positioned between the first end 12 and the second pivot point 15. An elongated connector 31 may be coupled to the second pivot point 15 via a pivotal coupling 24, and the second pivot point 15 may be positioned between the first pivot point 14 and the second end 13, a handle 41 may be coupled to the elongated connector 31 so that the handle 41 and pivot lever 11 are coupled to opposite ends of the elongated connector 31.

Figure 7:
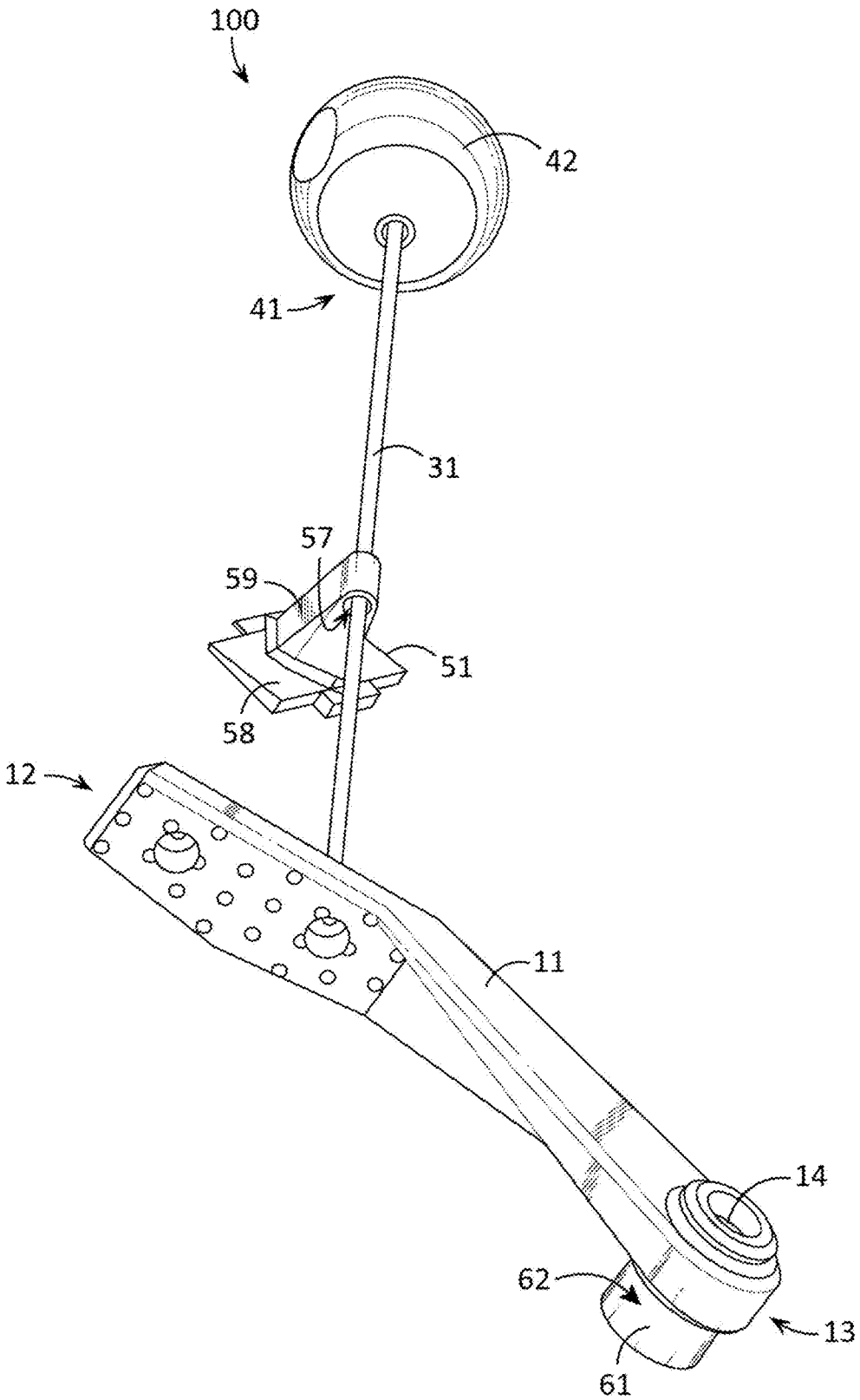
FIG. 7 depicts a front, bottom perspective view of another example of a binding safety release device according to various embodiments described herein.
Figure 8:
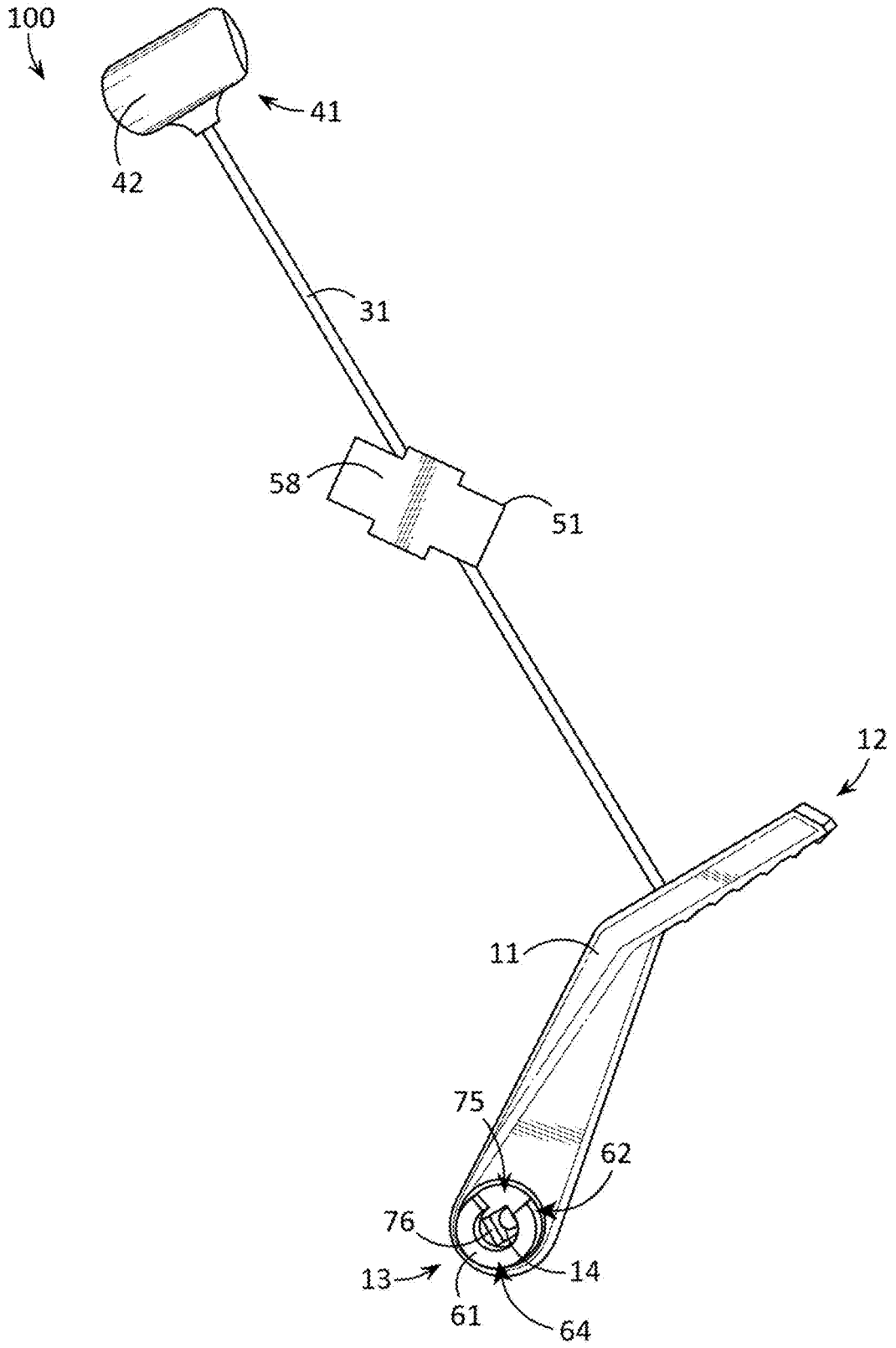
FIG. 8 illustrates a rear, top perspective view of another example of a binding safety release device according to various embodiments described herein.
Figure 9:
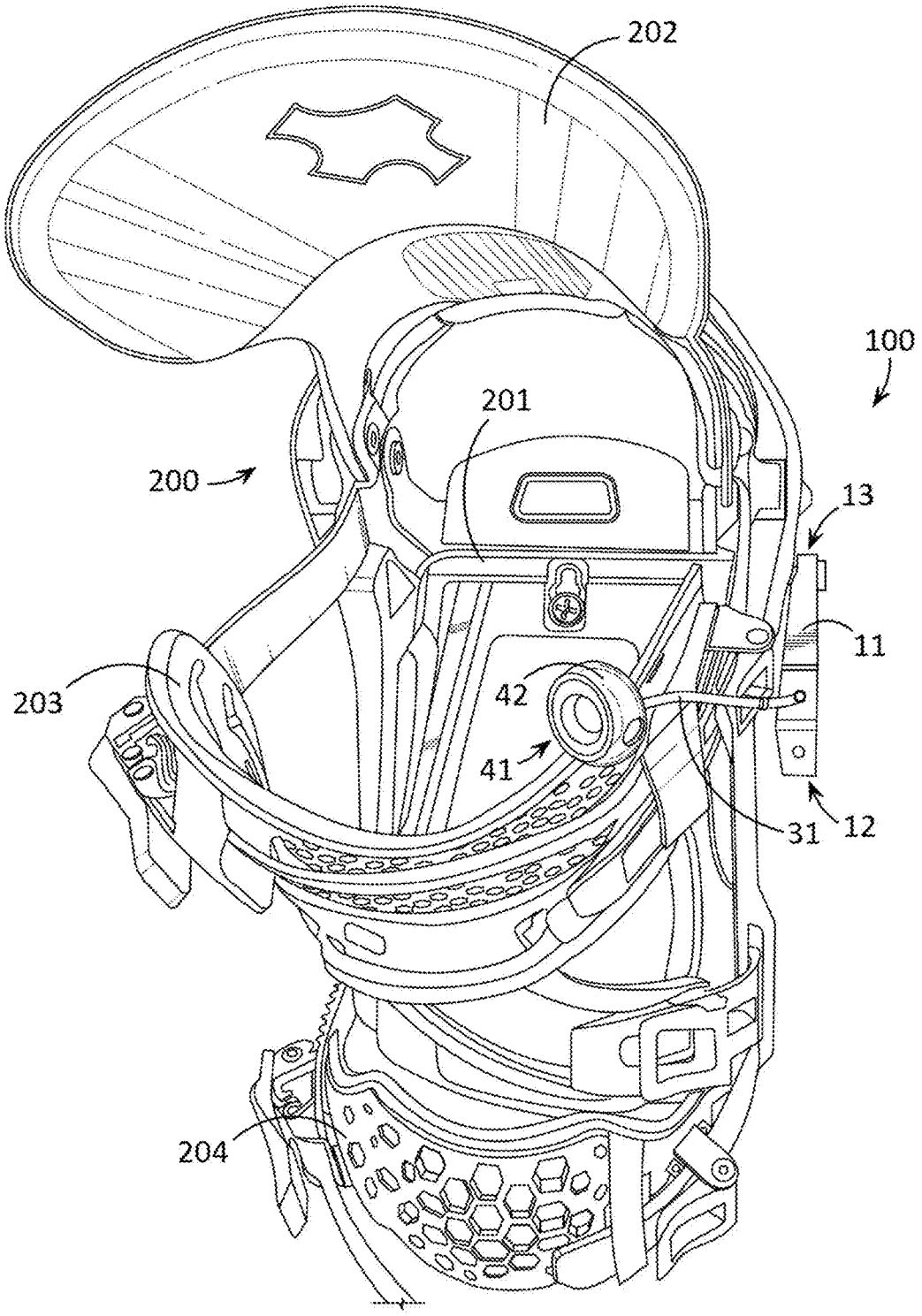
FIG. 9 shows a top perspective view of another example of a binding safety release device coupled to the binding release mechanism of a snowboard binding according to various embodiments described herein.

In some embodiments, and as shown in FIGS. 7-9, the device 100 may comprise a pivot lever 11 having a first end 12, a second end 13, and a first pivot point 14, and the first pivot point 14 may be positioned relatively closer to the second end 13 than to the first end 12. An elongated connector 31 may be coupled to the pivot lever 11 between the first end 12 and the first pivot point 14, and a handle 41 may be coupled to the elongated connector 31 so that the handle 41 and pivot lever 11 are coupled to opposite ends of the elongated connector 31.

In some embodiments, and as shown in FIGS. 10-16, the device 100 may comprise a pivot lever 11 having a first end 12, a second end 13, and a first pivot point 14, and the first pivot point 14 may be positioned proximate to the second end 13. The device 100 may include an elongated connector 31 having a lower receiver 21 that includes an upper end 22 and a lower end 23. The elongated connector 31 and/or pivot lever 11 may include a pivotal coupling 24 that may be coupled to the pivot lever 11 between the first pivot point 14 and the first end 12, and the pivotal coupling 24 may couple the elongated connector 31, e.g., the lower end 23 of the lower receiver 21, to the pivot lever 11. A threaded shaft 32 may be coupled to the lower receiver 21, and a handle 41 may be coupled to the threaded shaft 32 of the elongated connector 31 so that the handle 41 and lower receiver 21 are coupled to opposite ends of the threaded shaft 32 of the elongated connector 31.

The device 100 may comprise a pivot lever 11 which may be configured in any size and shape. A pivot lever 11 may comprise a first pivot point 14 and a second pivot point 15. Pivot points 14, 15, may comprise a shape, structure, or fastener, that may be coupled to an object and which may allow the pivot lever 11 to pivot or move relative to all or a portion of the object that the pivot point 14, 15, is coupled. In some embodiments, a pivot point 14, 15, may comprise an aperture that may be formed into the pivot lever 11 and which may extend through the pivot lever 11. In preferred embodiments, a pivot point 14, 15, may comprise a cylindrical shaped aperture that may be formed into the pivot lever 11 and which may extend through the pivot lever 11. Optionally, a pivot point 14, 15, may comprise a triangular prism shaped aperture, a rectangular prism shaped aperture, a hexagonal prism shaped aperture, or any other shaped aperture.

The pivot lever 11 may be configured to be engaged or coupled to a binding release mechanism 201 of a snowboard binding 200 so that movement of the pivot lever 11 may manipulate the action of the binding release mechanism 201. In preferred embodiments, a pivot lever 11 may have a first end 12 and a second end 13 which may be opposingly positioned to each other. Preferably, the largest dimension of the pivot lever 11 may comprise the distance between the first end 12 and the second end 13. In some embodiments, and as perhaps best shown in FIGS. 7-13 and 15, the first end 12 and all or a portion of the pivot lever 11 between the first end 12 and the second pivot point 15 and pivot fastener 16 may optionally be shaped as a lever-like handle that may be grasped and manipulated by a user as an optional interface for releasing a binding release mechanism 201 of a snowboard binding 200.

A snowboard binding 200 is the device that secures a rider's snowboard boots to their snowboard. It provides the connection between the boots and the board, enabling a rider to transfer their body weight and movements to control the board. Bindings come in various types and flex ratings. Generally, a snowboard binding 200 may comprise a highback 202 and a binding release mechanism 201. Optionally, a snowboard binding 200 may comprise one or more straps, such as an ankle strap 203, a foot strap 204, etc., which may be used to further secure a user's boots to the snowboard binding 200. The highback 202 of a snowboard binding 200 is the vertically oriented section that extends upwards from the heelcup, providing support and leverage for the rider's calf. It plays a crucial role in heel-side turns and overall board control. A binding release mechanism 201 is the mechanical linkage that is manipulated by a snowboard user in order to release the connection between the boots and the board. Generally, when a portion of the binding release mechanism 201 is pivoted or rotated in one direction, the binding release mechanism 201 may engage to a snowboard boot that is inserted into the snowboard binding 200, and when the portion of the binding release mechanism 201 is pivoted or rotated in an opposite direction, the binding release mechanism 201 may disengage or release the snowboard boot that is inserted into the snowboard binding 200.

In some embodiments, and as perhaps best shown in FIGS. 1-6, the pivot lever 11 may comprise a first pivot point 14 that may be positioned relatively closer to the first end 12 than the second pivot point 15 is positioned to the first end 12 so that the first pivot point 14 is positioned between the first end 12 and the second pivot point 15. The second pivot point 15 may be positioned proximate to the second end 13, optionally by being formed into the second end 13. In some embodiments, and as perhaps best shown in FIGS. 7-16, the pivot lever 11 may comprise a first pivot point 14 that may be positioned relatively closer to the second end 13 than to the first end 12.

In some embodiments, a first pivot point 14 may comprise an aperture (preferably cylindrical shaped aperture) through which a pivot fastener 16 may be inserted through, and the pivot fastener 16, e.g., a screw, bolt, rivet, or other fastener that may movably couple objects together while providing an axis around which one object may fully or partially pivot or rotate, may couple the pivot lever 11 to an object such as a binding release mechanism 201 of a snowboard binding. As an example, a binding release mechanism 201 may comprise a binding release mechanism of the Burton Step On® Bindings manufactured by Burton Snowboards of Vermont, U.S.A. As another example, a binding release mechanism 201 may comprise a binding release mechanism of Bent Metal snowboard bindings manufactured by Bent Metal Binding Works of Sequim, Washington, U.S.A. Preferably, a first pivot point 14 may be coupled to a binding release mechanism 201 via a pivot fastener 16 so that pivoting the pivot lever 11 around the first pivot point 14 and pivot fastener 16 results in pivoting or rotating of a portion of the binding release mechanism 201 relative to the snowboard binding 200 having the binding release mechanism 201. Generally, a pivot fastener 16 extends through the first pivot point 14 and may couple the pivot lever 11, and preferably the rear projecting wall 61, to the binding release mechanism 201. A pivot fastener 16 may comprise a screw, or other threaded fastener, pin, rod, bar, rivet, or any other fastener which may be used to couple two or more objects together.

In some embodiments, and as perhaps best shown in FIGS. 5, 9, 14, and 16, when the first pivot point 14 is coupled to the binding release mechanism 201 via a pivot fastener 16 so that the rear projecting wall 61 and its protrusions 65, 66, 67, 68, 69, and depressions 70, 71, 72, 73, 74, are in contact with the binding release mechanism 201, pushing down on the second end 13 (moving the second end 13 in a downward direction by pushing the handle 41 down e.g., moving the handle 41 in a direction towards the second end 13) causes the first pivot point 14, the rear projecting wall 61, and therefore the binding release mechanism 201, to pivot or rotate to disengage or release the snowboard boot that is inserted into the snowboard binding 200. Also in this manner, when the first pivot point 14 is coupled to the binding release mechanism 201 via a pivot fastener 16 so that the rear projecting wall 61 and its protrusions 65, 66, 67, 68, 69, and depressions 70, 71, 72, 73, 74, are in contact with the binding release mechanism 201, inserting a snowboard boot into snowboard binding 200 causes the first pivot point 14, the rear projecting wall 61, and therefore the binding release mechanism 201, to pivot or rotate in an opposite direction (moving the second end 13 in an upward direction by raising the handle 41 e.g., moving the handle 41 in a direction away from the second end 13) to engage or couple to a snowboard boot that is inserted into the snowboard binding 200.

In some embodiments, and as perhaps best shown in FIGS. 1-6, the pivot lever 11 may comprise a second pivot point 15 that may be positioned relatively farther from the first end 12 than the first pivot point 14 is positioned from the first end 12, such that the second pivot point 15 may be coupled to or proximate to the second end 13. In some embodiments, a second pivot point 15 may comprise an aperture through which a pivotal coupling 24 may be inserted through, and the pivotal coupling 24 may couple the pivot lever 11 to the lower end 23 of the lower receiver 21. In preferred embodiments, a pivotal coupling 24 may comprise a barbed pin that may be coupled to the elongated connector 31, such as to the lower end 23 of the lower receiver 21, and that may be mated with an aperture type of second pivot point 15 that may be formed in the pivot lever 11. In further embodiments, a second pivot point 15 may comprise a pin, rod, bar, or other similar structure that may be formed on the pivot lever 11 and inserted into an aperture type of third pivot point 25 of the elongated connector 31 so that the pin, rod, bar, or other similar structure may function as a pivotal coupling 24. Optionally, a second pivot point 15 may comprise a cylindrical shaped aperture, a triangular prism shaped aperture, a rectangular prism shaped aperture, a hexagonal prism shaped aperture, or any other shaped aperture. Optionally, a second pivot point 15 may comprise an aperture that may extend through the pivot lever 11. Optionally, a second pivot point 15 may comprise a depression that may extend into or be formed into the pivot lever 11.

In some embodiments, and as perhaps best shown in FIGS. 7-17, the pivot lever 11 may comprise a first pivot point 14 that may be positioned between the first end 12 and the second end 13 so that the first pivot point 14 is positioned proximate to the second end 13. In some embodiments, a first pivot point 14 may comprise an aperture through which a pivot fastener 16 may be inserted through, and the pivot fastener 16 may couple the pivot lever 11 to an object such as a binding release mechanism 201 of a snowboard binding. As an example, a binding release mechanism 201 may comprise a binding release mechanism of the Burton Step On® Bindings manufactured by Burton Snowboards of Vermont, U.S.A. Preferably, a first pivot point 14 may be coupled to a binding release mechanism 201 via a pivot fastener 16 so that pivoting the pivot lever 11 around the first pivot point 14 and pivot fastener 16 results in pivoting or rotating of a portion of the binding release mechanism 201 relative to the snowboard binding 200 having the binding release mechanism 201. Generally, a pivot fastener 16 extends through the first pivot point 14 and may couple the pivot lever 11, preferably the rear projecting wall 61 to the binding release mechanism 201. A pivot fastener 16 may comprise a screw, or other threaded fastener, pin, rod, bar, rivet, or any other fastener which may be used to couple two or more objects together.

In some embodiments, and as perhaps best shown in FIGS. 7-17, when the first pivot point 14 is coupled to the binding release mechanism 201 via a pivot fastener 16 so that the rear projecting wall 61 and its protrusions 65, 66, 67, 68, 69, and depressions 70, 71, 72, 73, 74, are in contact with the binding release mechanism 201, lifting the second end 13 (moving the second end 13 in a up direction by lifting the handle 41) causes the first pivot point 14, the rear projecting wall 61, and therefore the binding release mechanism 201, to pivot or rotate to disengage or release the snowboard boot that is inserted into the snowboard binding 200. Also in this manner, when the first pivot point 14 is coupled to the binding release mechanism 201 via a pivot fastener 16 so that the rear projecting wall 61 and its protrusions 65, 66, 67, 68, 69, and depressions 70, 71, 72, 73, 74, are in contact with the binding release mechanism 201, inserting a snowboard boot into snowboard binding 200 causes the first pivot point 14, the rear projecting wall 61, and therefore the binding release mechanism 201, to pivot or rotate in an opposite direction (moving the second end 13 in a down direction by lowering the handle 41) to engage or couple to a snowboard boot that is inserted into the snowboard binding 200.

In some embodiments, and as perhaps best shown in FIGS. 7-17, the pivot lever 11 may comprise a second pivot point 15 that may be positioned between the first end 12 and the first pivot point 14 so that the second pivot point 15 is positioned approximately midway between the first end 12 and the second end 13. In some embodiments, a second pivot point 15 may comprise an aperture through which a pivotal coupling 24 may be inserted through, and the pivotal coupling 24 may couple the pivot lever 11 to the lower end 23 of the lower receiver 21 of the elongated connector 31. In some embodiments, a second pivot point 15 may comprise a pin, rod, bar, or other similar structure that may be formed on the pivot lever 11 and inserted into an aperture type of third pivot point 25 the lower receiver 21 so that the pin, rod, bar, or other similar structure may function as a pivotal coupling 24.

In some embodiments, and as perhaps best shown in FIGS. 3, 4, 7, 8, 12, 13, and 17, the device 100 may comprise a rear projecting wall 61. Generally, a rear projecting wall 61 may be coupled to the pivot lever 11 so that the rear projecting wall extends away from the pivot lever 11 in a direction that is approximately perpendicular to an axis or direction that extends through the first end 12 and the second end 13. The rear projecting wall 61 may extend around at least a portion of the first pivot point 14, and more preferably the rear projecting wall 61 may extend around, e.g., encircle, the first pivot point 14. A rear projection wall 61 may contact and engage with a binding release mechanism 201, preferably by being coupled to the binding release mechanism 201 via a pivot fastener 16 that extends through the first pivot point 14 and into the binding release mechanism 201 so that movement of the rear projection wall 61 may be communicated to the binding release mechanism 201, such as to cause the binding release mechanism 201 to release. In further embodiments, the device 100 may comprise a snowboard binding 200 having a highback 202 and a binding release mechanism 201, and the first pivot point 14 and rear projecting wall 61 may be coupled to the binding release mechanism 201, such as with a pivot fastener 16.

Figure 3:
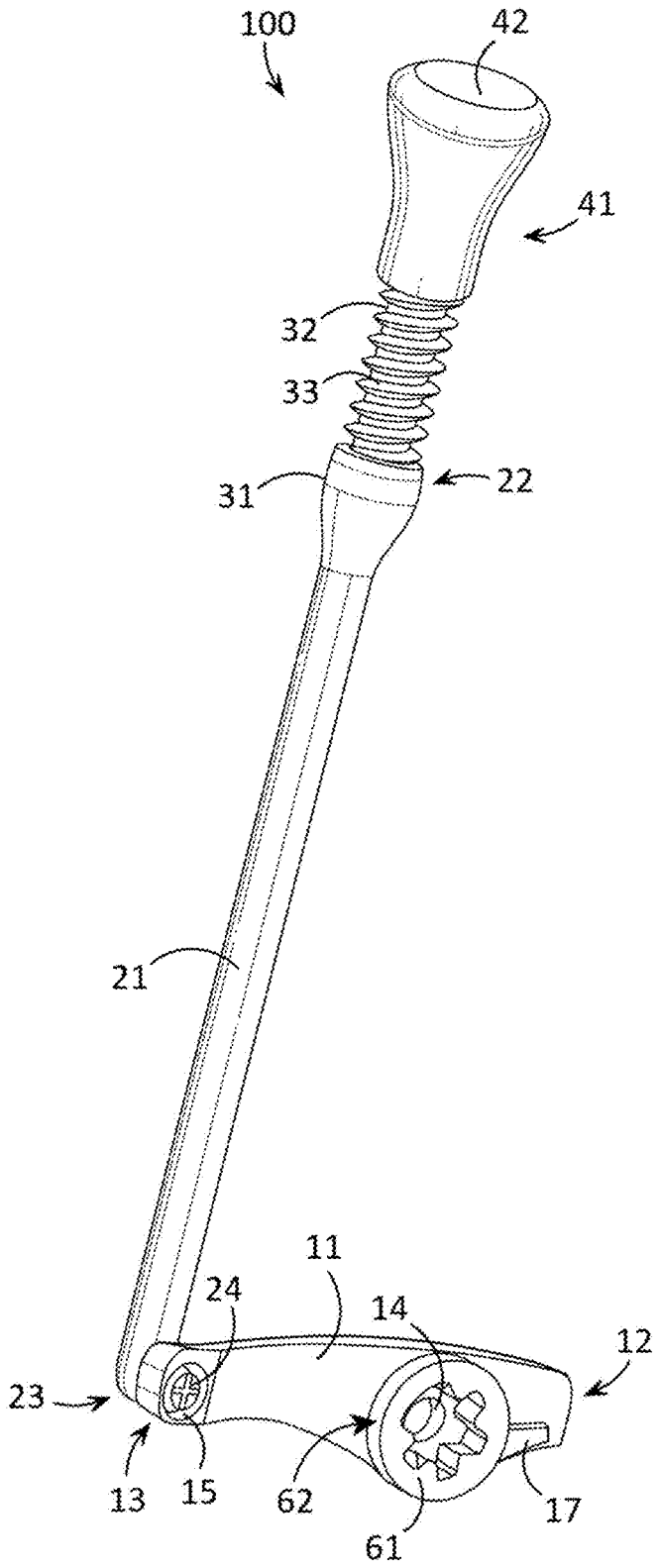
FIG. 3 shows a rear perspective view of an example of a binding safety release device according to various embodiments described herein.
Figure 4:
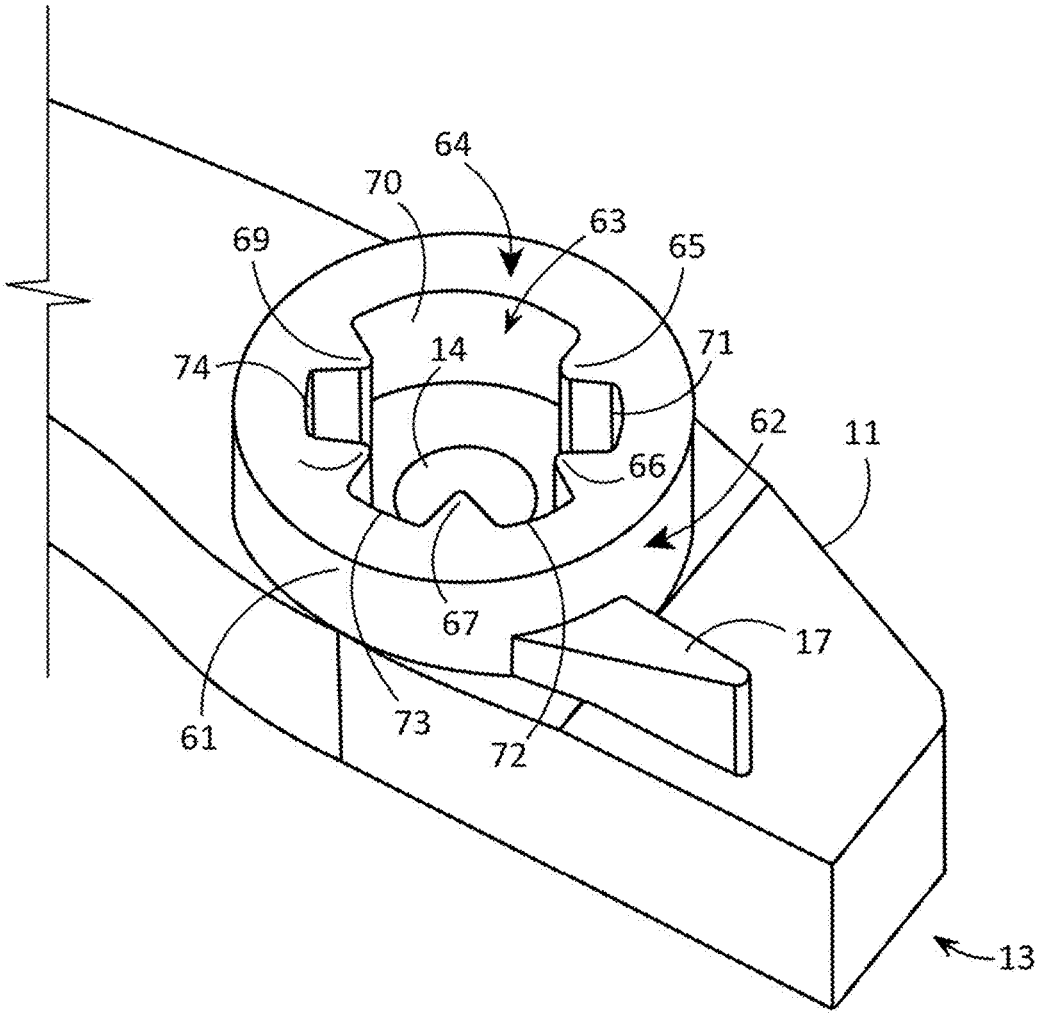
FIG. 4 depicts a partial perspective view of the back of an example pivot lever according to various embodiments described herein.
Figure 5:
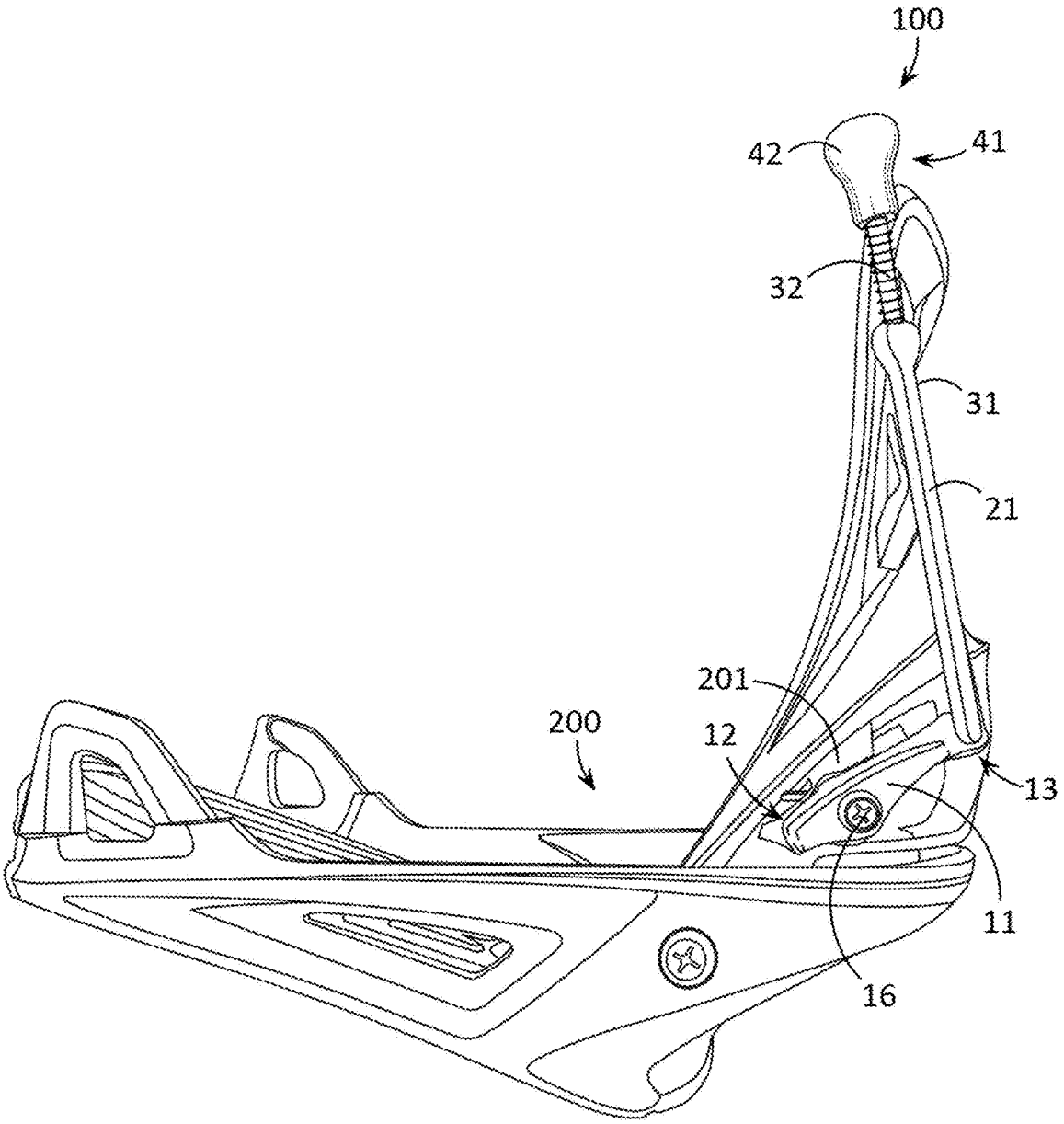
FIG. 5 illustrates a perspective view of an example of a binding safety release device coupled to the binding release mechanism of a snowboard binding according to various embodiments described herein.
Figure 6:
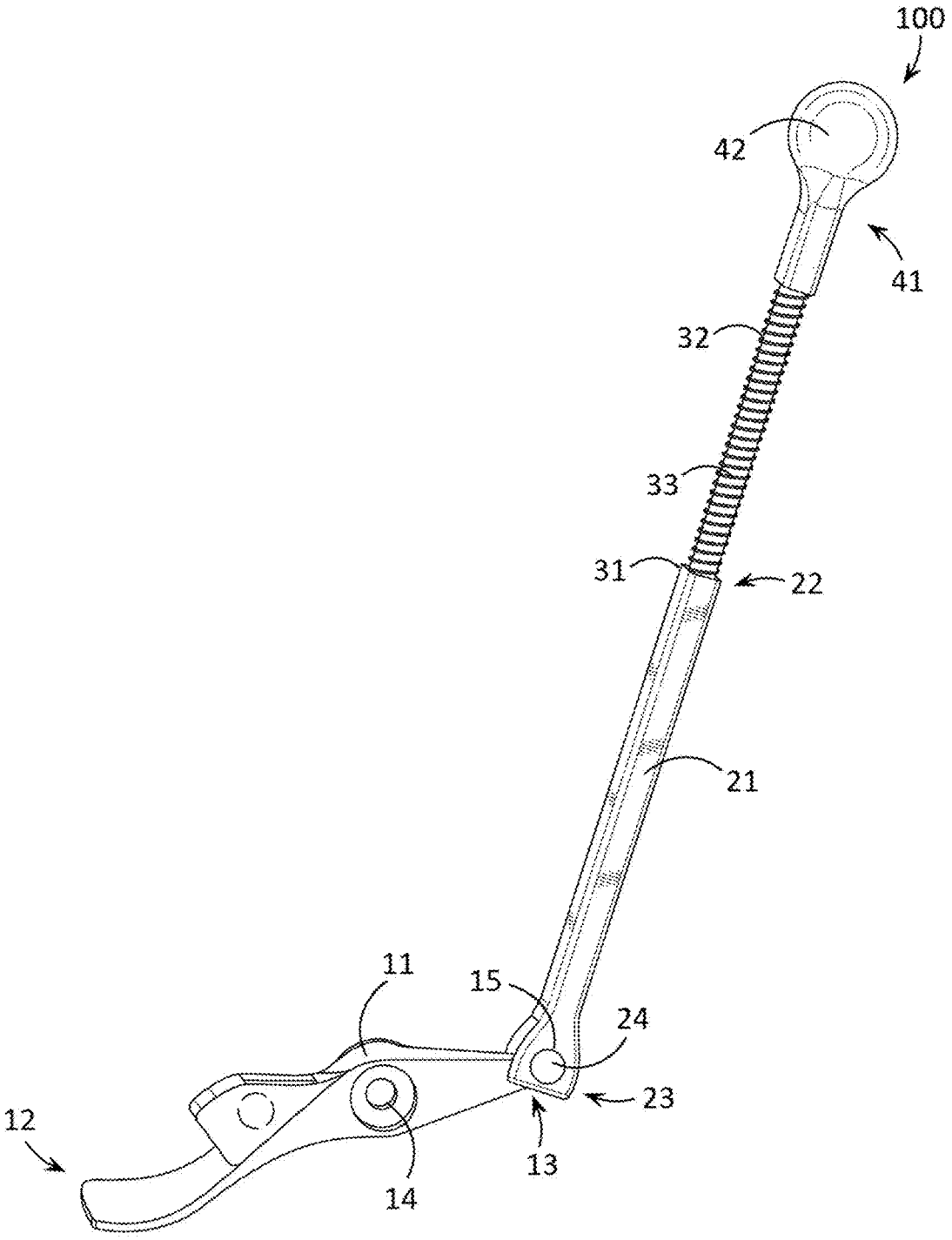
FIG. 6 shows a front perspective view of another example of a binding safety release device according to various embodiments described herein.

In some embodiments, and as perhaps best shown in FIGS. 3 and 4, a rear projection wall 61 may be coupled to the pivot lever 11 so that it is positioned between the first end 12 and the second end 13 and/or positioned between the first end 12 and the second pivot point 15. In some embodiments, and as perhaps best shown in FIGS. 7-17, a rear projection wall 61 may be coupled to or proximate to the second end 13 of the pivot lever 11.

In some embodiments, a rear projection wall 61 may comprise a distal surface 64 that may be the portion of the rear projection wall 61 that is furthest from the pivot lever 11. In preferred embodiments, and as perhaps best shown in FIGS. 4, 9, and 17, the rear projecting wall 61 may comprise a distal surface 64 that is planar or flat in shape.

A rear projecting wall 61 may be configured in any size and shape. In preferred embodiments, a rear projecting wall 61 may comprise a cylindrical surface 62 (a cylindrical surface 62 may be substantially shaped as a portion of the curved surface of a cylinder, such as to extend around a portion of the first pivot point 14, or shaped as a full curved surface of a cylinder, such as to fully extend around or surround the first pivot point 14) that may extend away from portions of the pivot lever 11 that the rear projecting wall 61 is coupled to. In some embodiments, and as perhaps best shown in FIGS. 3, 4, 8, 12, and 17, the rear projecting wall 61 may extend around all or a portion of the first pivot point 14. In some embodiments and as perhaps best shown in FIG. 8, the device 100 may comprise a wall cut out 75 that may be formed in the rear projecting wall 61 so as to decrease the size of the cylindrical surface 62, e.g., such as by making the cylindrical surface shaped as a portion of the curved surface of a cylinder. For example, a wall cut out may decrease the cylindrical surface by an arc of approximately between 75 and 105 degrees. Preferably, the wall cut out 75 may face away from the second end 13, e.g., wall cut out 75 and second end 13 positioned on approximately opposite sides of the rear projecting wall 61.

In preferred embodiments, the first pivot point 14 may comprise an aperture that is cylindrical in shape, and the aperture and cylindrical surface 62 may be concentric with each other (e.g., the axis of the cylindrical shape of the aperture of the first pivot point 14 may substantially pass through the axis of the cylindrical surface 62). In some embodiments and as perhaps best shown in FIG. 8, the device 100 may comprise a rectangular prism depression 76 that is depressed into the lever arm 11 below the rear projecting wall 61, and the rectangular prism depression 76 may extend around the aperture of the first pivot point 14. Generally, the rectangular prism depression 76 may comprise a depression or recess that may have a rectangular prism shape, and more preferably a cuboid or cube shape. Preferably, the rear projecting wall 61 may comprise a wall cavity 63 that may be depressed below the distal surface 64. A wall cavity 63 may be in communication with the first pivot point 14.

In some embodiments, the rear projection wall 61 may comprise one or more protrusions 65, 66, 67, 68, 69, and depressions 70, 71, 72, 73, 74, that may be disposed in the wall cavity 63. Generally, depressions 70, 71, 72, 73, 74, may comprise depressions or recesses that may be recessed into the projecting wall 61 away from the first pivot point 14, and protrusions 65, 66, 67, 68, 69, may comprise projections or protrusions that extend a greater distance away from the cylindrical surface 62 than the depressions 70, 71, 72, 73, 74. Protrusions 65, 66, 67, 68, 69, may be configured in any size and shape, such as the generally elongated triangular prism shape as perhaps best shown in FIGS. 4 and 17. Depressions 70, 71, 72, 73, 74, may be configured in any size and shape, such as the generally elongated rounded prism shape as perhaps best shown in FIGS. 4 and 17. In preferred embodiments, the rear projecting wall 61 may comprise at least two depressions 70, 71, 72, 73, 74, that are each recessed into the projecting wall 61 away from the first pivot point 14, and the two depressions may be separated from each other by a protrusion 65, 66, 67, 68, 69, that extends towards the first pivot point 14 as perhaps best shown in FIGS. 4 and 17.

In some embodiments, the device 100 may comprise a lever tooth 17 that may be coupled to the pivot lever 11, such as by being coupled to the cylindrical surface 62 of the rear projecting wall 61 and which may extend towards the first end 12. In some embodiments, a lever tooth 17 may be configured with a generally triangular prism shape having a vertex edge facing towards the first end 12 and away from the second end 13 as perhaps best shown in FIGS. 3, 4, 12 and 17.

The device 100 may comprise an elongated connector 31 that may couple the handle 41 to the pivot lever 11. In some embodiments, and as perhaps best shown in FIGS. 7-9 an elongated connector 31 may comprise a fixed length. In some embodiments, an elongated connector 31 may comprise a fixed length and may be made from a resilient material, such as coiled wire, a plastic rod, a metal rod, etc., so that the elongated connector 31 may be able to flex or bend slightly while still being able to exert a pushing force and pulling force on the pivot lever 11 as a user pushes and pulls on the handle 41.

In some embodiments, and as perhaps best shown in FIGS. 1-3, 5, 6, and 10-16, an elongated connector 31 may be adjustable in length. For example, an elongated connector 31 may comprise a lower receiver 21, having an upper end 22 and a lower end 23, that preferably may be configured to couple the elongated connector 31 to a pivot lever 11. The adjustable elongated connector 31 may comprise a threaded shaft 32 that may be movably coupled to the lower receiver 21, and a handle 41 may be coupled to the threaded shaft 32 so that the handle 41 and threaded shaft 32 are coupled to opposite ends of the lower receiver 21 of the elongated connector 31. A lower receiver 21 may be configured in any size and shape. In preferred embodiments, a lower receiver 21 may be elongated in shape. An upper end 22 may be coupled to the threaded shaft 31 and the lower end 23 may be coupled to the pivot lever 11.

Figure 10:
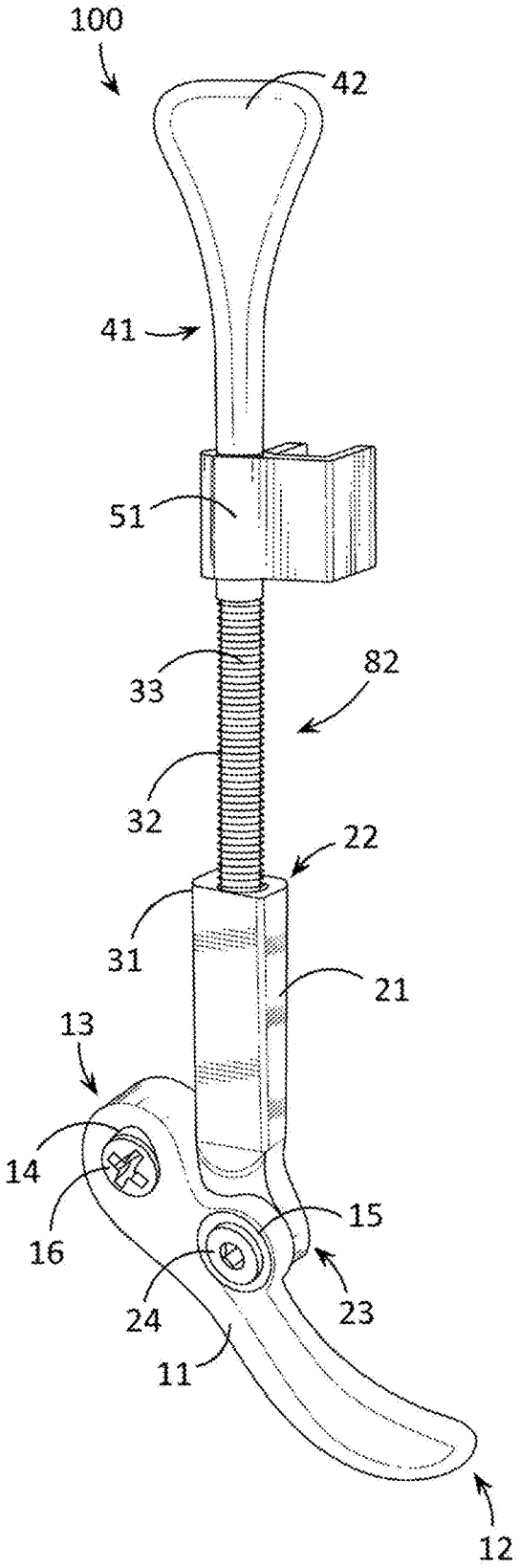
FIG. 10 depicts a front perspective view of a further example of a binding safety release device in a second position according to various embodiments described herein.
Figure 11:
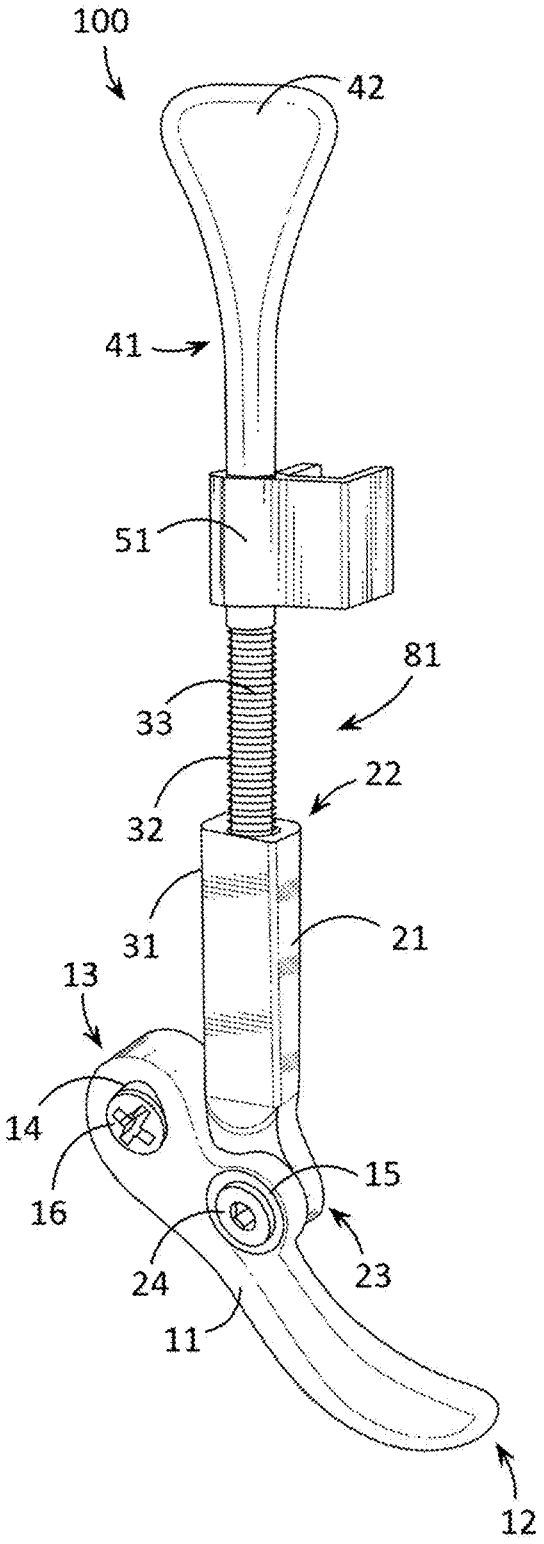
FIG. 11 illustrates a front perspective view of a further example of a binding safety release device in a first position according to various embodiments described herein.
Figure 12:
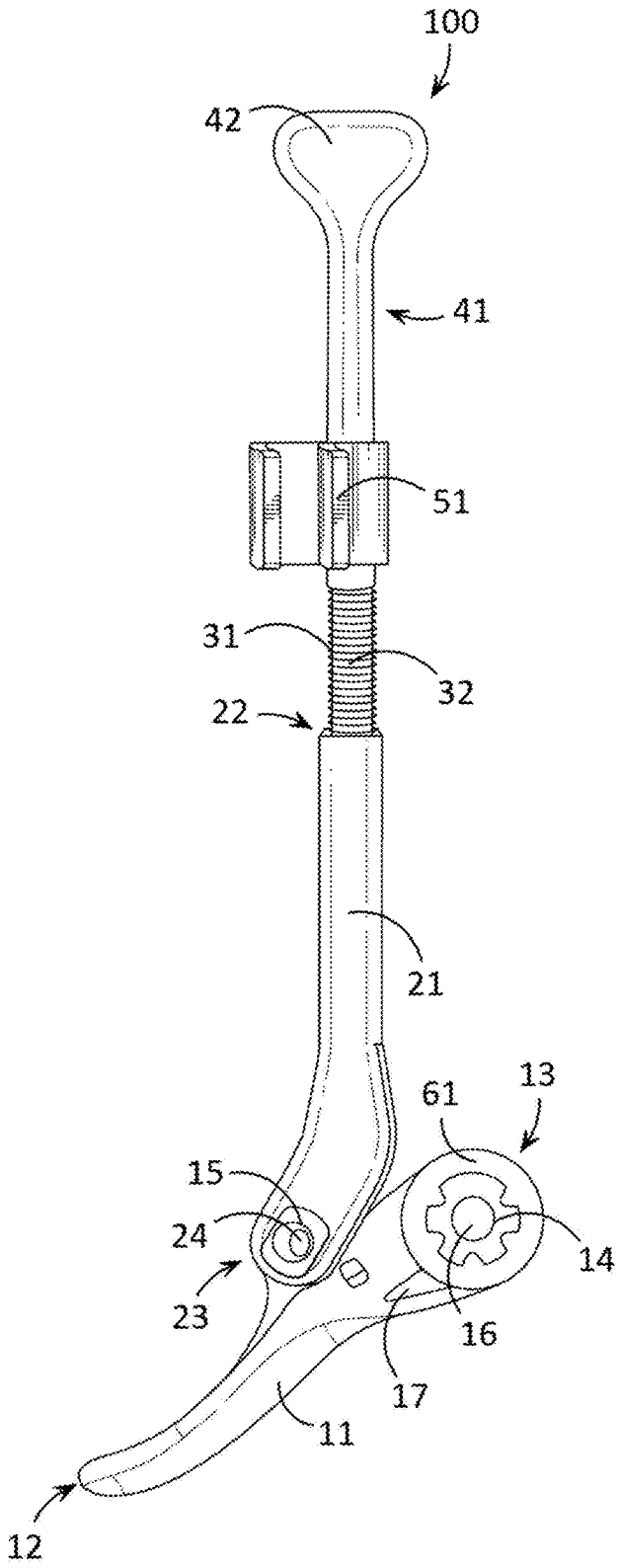
FIG. 12 shows a rear perspective view of a further example of a binding safety release device according to various embodiments described herein.
Figure 13:
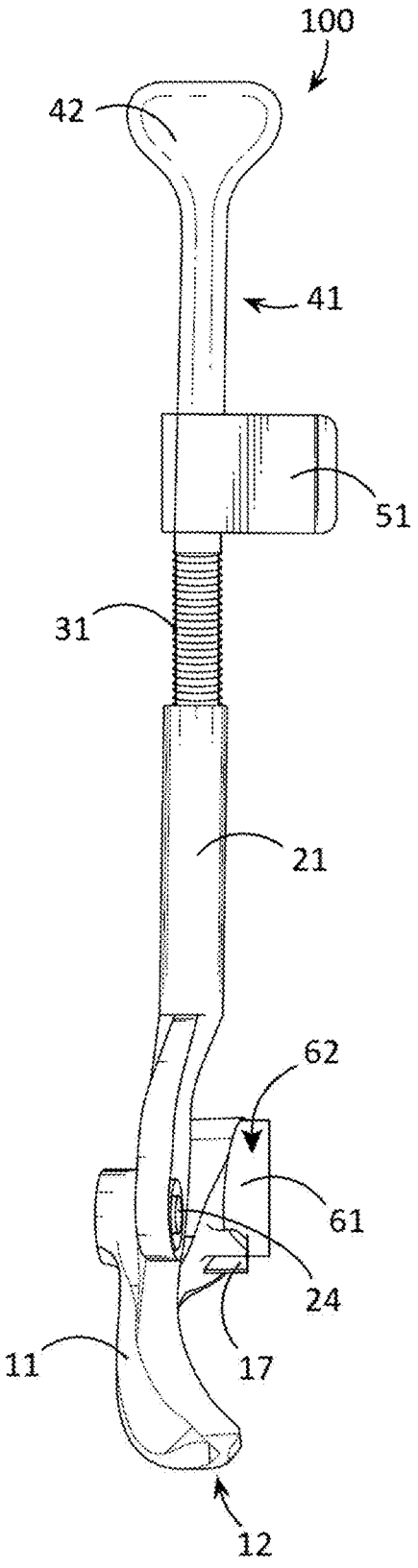
FIG. 13 depicts a side elevation view of a further example of a binding safety release device according to various embodiments described herein.

In some embodiments, and as shown in FIGS. 10-16, the device 100 may comprise a pivotal coupling 24 that may be coupled to the pivot lever 11 between the first pivot point 14 and the first end 12, and the pivotal coupling 24 may couple the lower end 23 of the lower receiver 21 to the pivot lever 11. In some embodiments and as perhaps best shown in FIGS. 3 and 6, the device 100 may comprise a pivotal coupling 24 that may be coupled to the pivot lever 11 between the first pivot point 14 and the second end 13 (such as to or proximate to the second end 13), and the pivotal coupling 24 may couple the lower end 23 of the lower receiver 21 to the pivot lever 11. Optionally, a pivotal coupling 24 may comprise a screw, or other threaded fastener, pin, rod, bar, rivet, or any other fastener which may be used to couple two or more objects together while allowing the objects to pivot or rotate relative to each other. In some embodiments, the lower receiver 21 may comprise a pivot point that may be located at or proximate to the lower end 23. In some embodiments and as shown in FIGS. 10-12, a pivot point on the lower end 23 may comprise an aperture through which a pivotal coupling 24 may be inserted through, and the pivotal coupling 24 may couple the pivot lever 11 to the lower end 23 of the lower receiver 21. In some embodiments, and as perhaps best shown in FIGS. 3 and 6, a pivot point on the lower end 23 may comprise may comprise pivotal coupling 24 that may be a pin, rod, bar, or other similar structure that may be formed on the lower receiver 21 and inserted into an aperture type of second pivot point 15 formed in the pivot lever 11 so that the pin, rod, bar, or other similar structure may be or function as a pivotal coupling 24.

An elongated connector 31 may comprise a threaded shaft 32 that may be movably coupled to the lower receiver 21, and a handle 41 may be coupled to the threaded shaft 32 so that the handle 41 and threaded shaft 32 are coupled to opposite ends of the lower receiver 21 of the elongated connector 31. An elongated connector 31 may be configured in any shape and size. In preferred embodiments, an elongated connector 31 may comprise an elongated shape, having a length substantially greater than its width and height. In some embodiments, an elongated connector 31 may comprise an elongated cylindrical shape, elongated hexagonal prism shape, elongated triangular prism shape, elongated rectangular prism shape, or any other shape including combinations of shapes.

The device 100 may comprise a handle 41 that may be coupled to the elongated connector 31, and the handle 41 may comprise a shape that may facilitate a user's ability to grasp and manipulate the handle 41, such as to facilitate a user's ability to grab and pull the handle in a direction away from the lower receiver 31 and pivot lever 11. In preferred embodiments, the handle 41 may comprise a knob 42. Generally, a knob 42 may be a small, optionally rounded, or other handle-like piece used for various purposes like adjusting, controlling, or pulling/pushing via one or more fingers of a user. In further embodiments, a handle 41 may comprise a ring or annular shape, a generally hook shape, a pull cord, or any other shape which may be easily grasped and manipulated by user to grab and pull the handle in a direction away from the lower receiver 31 and pivot lever 11.

In preferred embodiments, the elongated connector 31 may be adjustable in length and device 100 may be movable between a first position 81 and a second position 82. Preferably, the handle 41 may be relatively closer to the lower receiver 21 and/or to the pivot lever 11 when the device 100 is in the first position 81, and the handle 41 may be relatively farther from the lower receiver 21 and/or pivot lever 11 when the device 100 is in the second position 82.

In preferred embodiments, the handle 41 and/or the lower receiver 21 may be movably coupled to the elongated connector 31 to enable the device 100 to be moved into and between the positions 71, 72. In some embodiments, the elongated connector 31 may comprise a threaded shaft 32 having threading 33, and the threaded shaft 32 may be movably coupled to the lower receiver 21 via a threaded engagement between the threaded shaft 32 and the lower receiver 21 (e.g., the threading 33 of the threaded shaft 32 may be threaded into a threaded aperture of the lower receiver 21). In some embodiments the elongated connector 31 may comprise threading 33, and the elongated connector 31 may be movably coupled to the handle 41 via a threaded engagement between the elongated connector 31 and the handle 41 (e.g., the threading 33 of the elongated connector 31 may be threaded into a threaded aperture of the handle 41).

Figure 14:
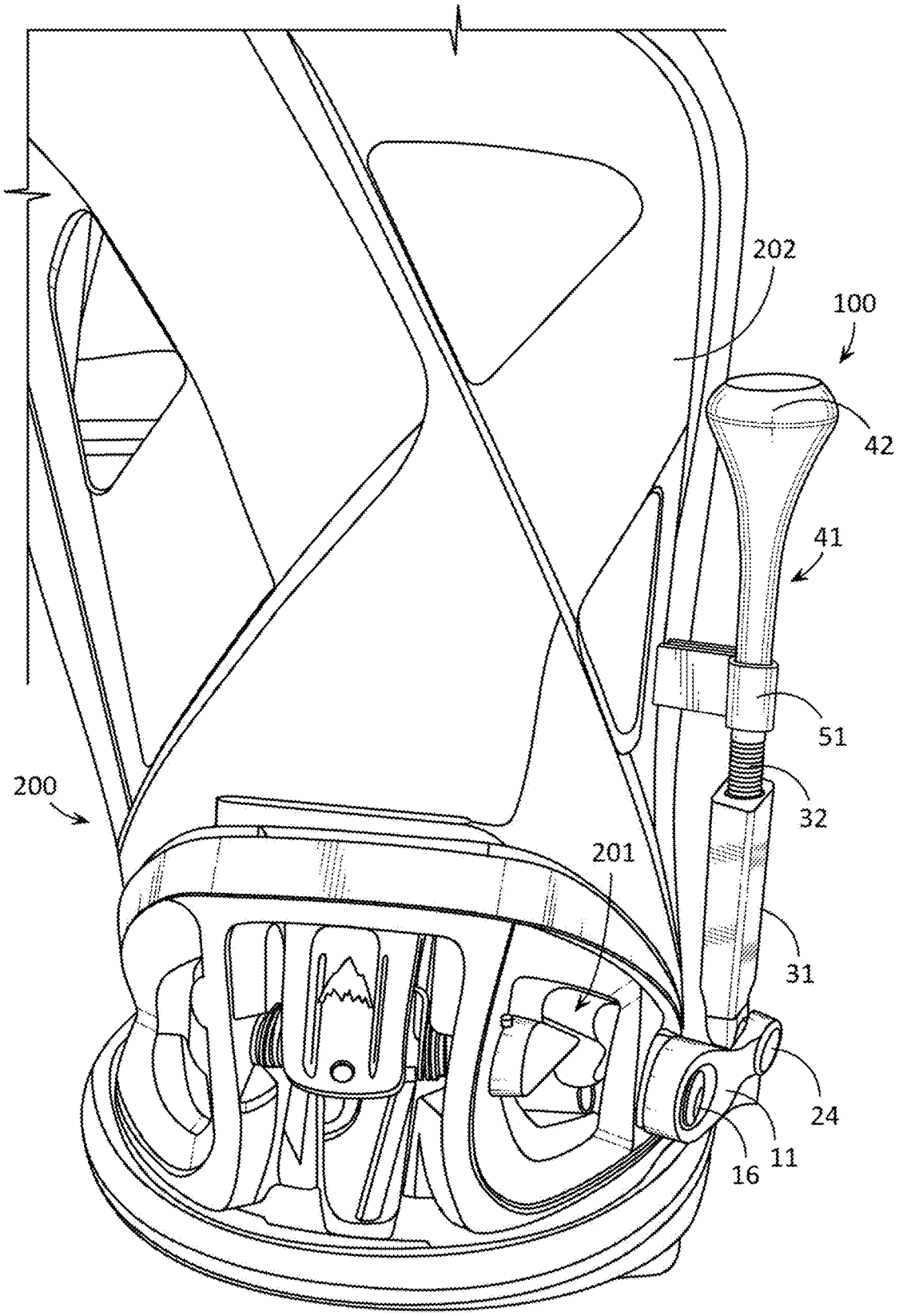
FIG. 14 illustrates a rear perspective view of a further example of a binding safety release device coupled to the binding release mechanism of a snowboard binding according to various embodiments described herein.
Figure 15:
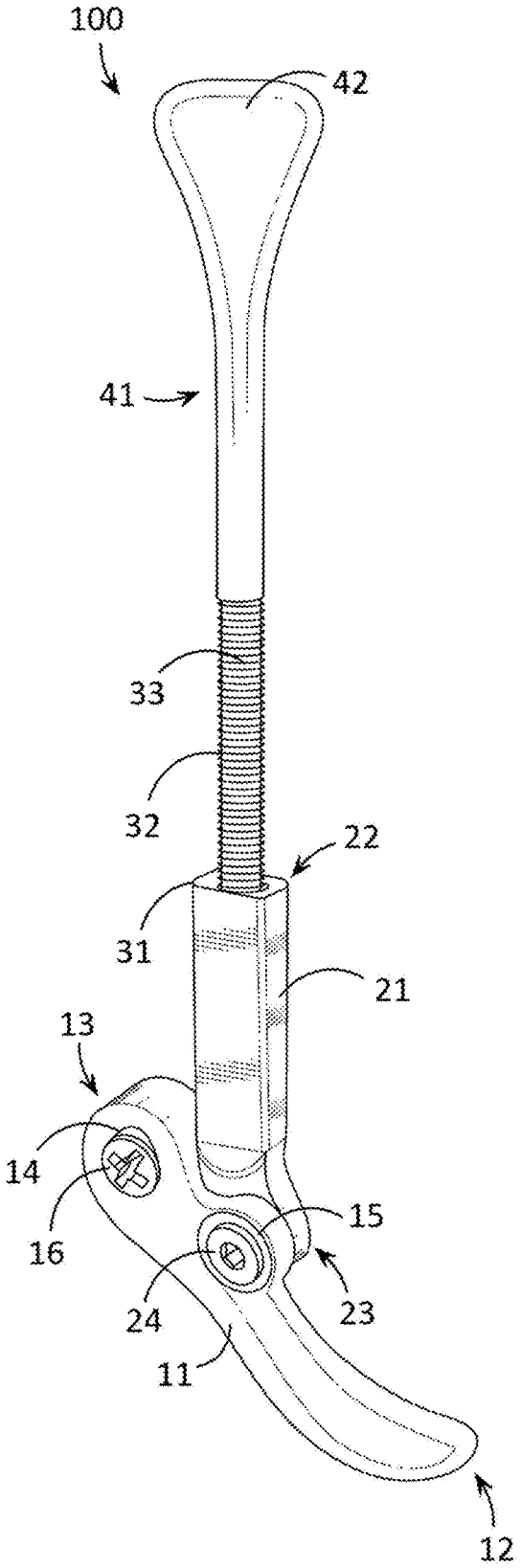
FIG. 15 shows a front perspective view of yet another example of a binding safety release device according to various embodiments described herein.
Figure 16:
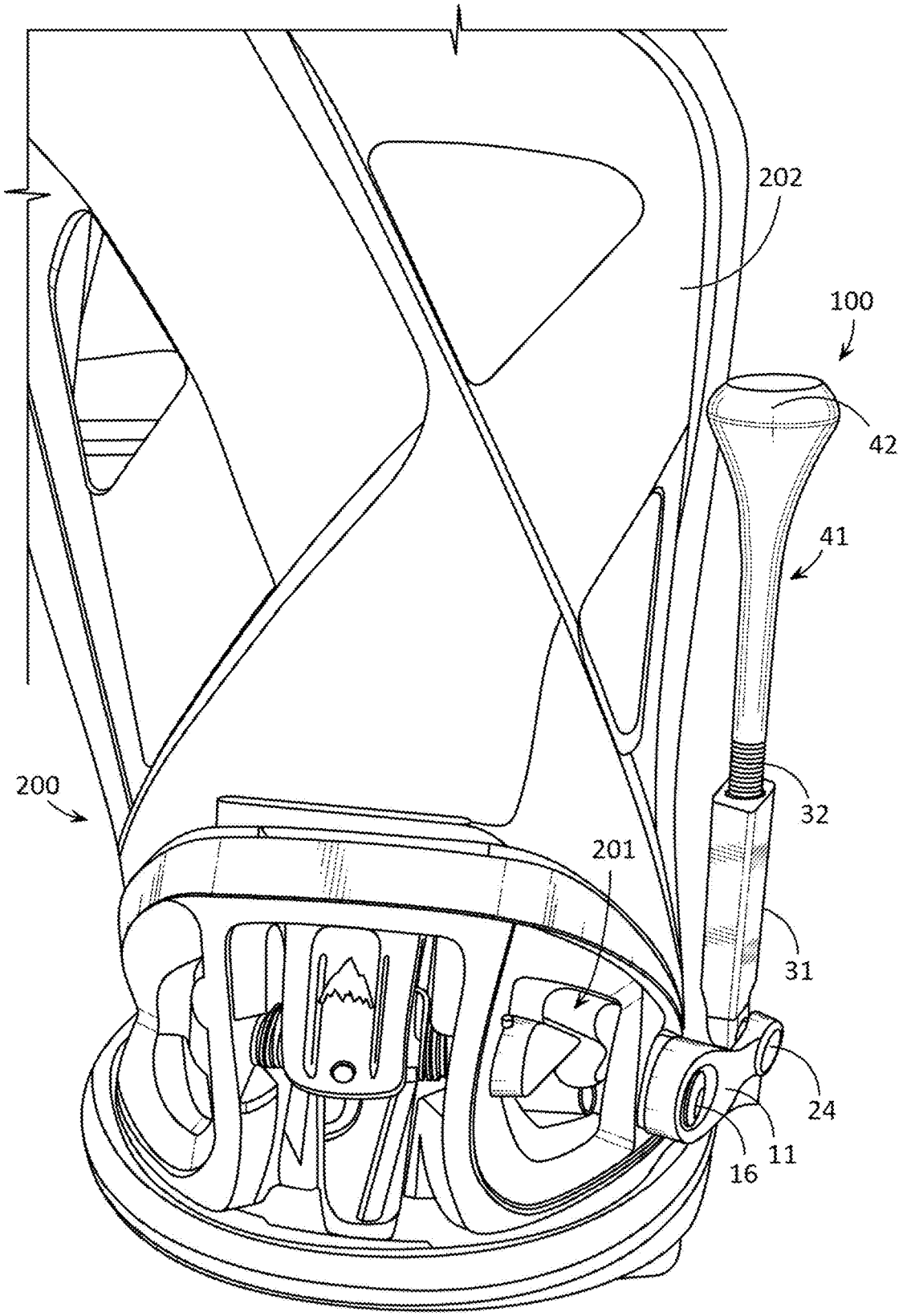
FIG. 16 depicts a rear perspective view of yet another example of a binding safety release device coupled to the binding release mechanism of a snowboard binding according to various embodiments described herein.
Figure 17:
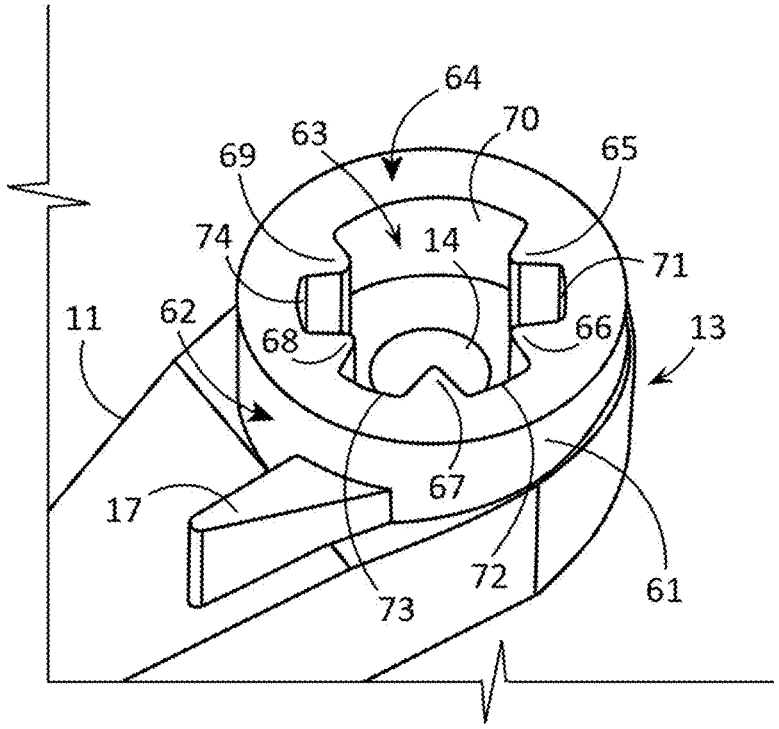
FIG. 17 illustrates a partial perspective view of the back of yet another example of a pivot lever according to various embodiments described herein.
Figure 18:
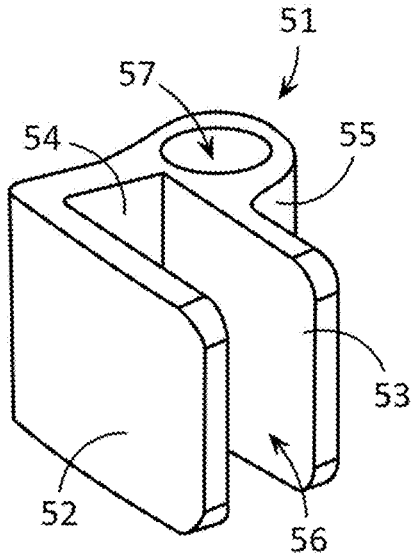
FIG. 18 shows a perspective view of another example of a guide according to various embodiments described herein.

In some embodiments and as perhaps best shown in FIGS. 7-9, 10-14, and 18, the device 100 may comprise a guide 51. Optionally, a guide 51 may be coupled to a portion of a snowboard binding 200, such as to the highback 202 or other portion of a snowboard binding 200 (as shown in FIGS. 9 and 14) and a portion of the elongated connector 31 may be movably engaged to the guide 51 to that the portion of the elongated connector 31 may move back and forth through the guide 51 while the guide 51 is coupled to the snowboard binding 200 to ensure the positioning of the handle 41 relative to the binding release mechanism 201. A highback 202 on a snowboard binding 200 is the vertical piece that extends from the back of the binding, supporting a user's calf and providing leverage for heel-edge control. Preferably, a guide 51 may be coupled to a highback 202, ankle strap 203, or other portion of the snowboard binding 200 with a portion of the elongated connector 31 movably engaged to the guide 51 to ensure that the handle 41 is always in the correct position relative to the highback 202 of the snowboard binding 200 and to ensure that the elongated connector 31 can slide freely up and down inside the guide 51 (inside a channel 56, 57, of the guide 51). A guide 51 may be coupled to a highback 202 via 3M™ VHB™ Tape or any other suitable coupling method. Optionally, and as perhaps best shown in FIGS. 7, 10-14, and 18, a guide 51 may comprise a closed channel 57 that may be configured as an enclosed conduit or tunnel through a portion of the guide 51, such as through a portion of a guide wall 53, 54, 55, 59, with a portion of the elongated connector 31 positioned within the closed channel 57, and the guide 51 may be coupled to the snowboard binding 200.

A guide 51 may be configured in any shape and size. In preferred embodiments, a guide 51 may comprise one or more guide walls 52, 53, 54, 55, 58, 59, that may be coupled to a binding release mechanism 201. In some embodiments, a guide 51 may comprise two generally planar shaped walls 52, 53, that may be substantially parallel to each other and which may be coupled together via a third wall 54. Preferably, the guide 51 may comprise a rounded wall 55 that may be coupled to or formed into one or more of the planar shaped walls 53 and/or third wall 54. In further embodiments, guide walls 52, 53, 54, 55, 58, 59, may be configured in any size and shape.

In preferred embodiments, a guide 51 may comprise one or more channels 56, 57, and a portion of the elongated connector 31 may be positioned within the channel 56, 57. In further preferred embodiments, the portion of the elongated connector is movable within the channel 56, 57.

In some embodiments, a guide 51 may comprise an open channel 56 that may be formed between one or more guide walls 52, 53, 54, 55. An open channel 56 may be configured in any shape and size and may be open on one side so that objects may be moved into and out of the open side. Preferably, an open channel 56 may be sized and shaped to enable a portion of the elongated connector 31 to be inserted through and moved through the open channel 56.

In some embodiments, a guide 51 may comprise a closed channel 57 that may be formed into or by one or more guide walls 53, 54, 55, 59, may be configured in any shape and size and may be substantially closed so as to form a conduit that may be sized and shaped to enable a portion of the elongated connector 31 to be inserted through and moved through the closed channel 57.

While some exemplary shapes and sizes have been provided for elements of the device 100, it should be understood to one of ordinary skill in the art that the pivot lever 11, elongated connector 31, handle 41, guide 51, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A binding safety release device for releasing the binding release mechanism of a snowboard binding, the device comprising:

a pivot lever having a first end, a second end, and a pivot point, wherein the pivot point is positioned relatively closer to the second end than to the first end;

an elongated connector that is coupled to the pivot lever between the first end and the pivot point; and a handle coupled to the elongated connector so that the handle and pivot lever are coupled to opposite ends of the elongated connector, wherein the pivot point is attachable to the binding release mechanism, wherein when the handle is pulled on, the movement of the handle is communicated to the binding release mechanism via the pivot lever to cause the binding release mechanism to release.

2. The binding safety release device of claim 1, further comprising a snowboard binding having a highback and a binding release mechanism, wherein the pivot point is coupled to the binding release mechanism.

3. The binding safety release device of claim 2, further comprising a guide, wherein the guide comprises a channel, wherein a portion of the elongated connector is positioned within the channel, and wherein the guide is coupled to the snowboard binding.

4. The binding safety release device of claim 1, further comprising a rear projecting wall coupled to the pivot lever, wherein the rear projecting wall is coupled to the pivot lever so that the rear projecting wall extends away from the pivot lever in a direction that is approximately perpendicular to an axis or direction that extends through the first end and the second end.

5. The binding safety release device of claim 1, further comprising a rear projecting wall coupled to the pivot lever, wherein the rear projecting wall comprises a distal surface that is planar in shape, wherein the rear projecting wall comprises a cylindrical surface, and wherein the cylindrical surface separates the distal surface from the pivot lever.

6. The binding safety release device of claim 4, wherein the rear projecting wall extends around at least a portion of the pivot point.

7. The binding safety release device of claim 4, wherein the rear projecting wall comprises a cylindrical surface.

8. The binding safety release device of claim 7, wherein the pivot point comprises an aperture that is cylindrical in shape, and wherein the aperture and cylindrical surface are concentric with each other.

9. The binding safety release device of claim 8, further comprising a rectangular prism depression that is depressed into the lever arm below the rear projecting wall, wherein the rectangular prism depression extends around the aperture.

10. The binding safety release device of claim 4, further comprising a wall cut out formed in the rear projecting wall, wherein the wall cut out faces away from the second end.

11. A binding safety release device, the device comprising:

a pivot lever having a first end, a second end, and a pivot point, wherein the pivot point is positioned relatively closer to the second end than to the first end, wherein the pivot point comprises an aperture that is cylindrical in shape;

a rear projecting wall coupled to the pivot lever;

a rectangular prism depression that is depressed into the pivot lever below the rear projecting wall, wherein the rectangular prism depression extends around the aperture;

an elongated connector that is coupled to the pivot lever between the first end and the pivot point; and a handle coupled to the elongated connector so that the handle and pivot lever are coupled to opposite ends of the elongated connector.

12. The binding safety release device of claim 11, further comprising a guide, wherein the guide comprises a channel, wherein a portion of the elongated connector is positioned within the channel, and wherein the guide is coupled to the snowboard binding.

13. The binding safety release device of claim 11, wherein the rear projecting wall is coupled to the pivot lever so that the rear projecting wall extends away from the pivot lever in a direction that is approximately perpendicular to an axis or direction that extends through the first end and the second end.

14. The binding safety release device of claim 11, wherein the rear projecting wall comprises a distal surface that is planar in shape, wherein the rear projecting wall comprises a cylindrical surface, and wherein the cylindrical surface separates the distal surface from the pivot lever.

15. The binding safety release device of claim 11, wherein the rear projecting wall extends around at least a portion of the pivot point.

16. The binding safety release device of claim 11, wherein the rear projecting wall comprises a cylindrical surface.

17. The binding safety release device of claim 11, wherein the aperture and cylindrical surface are concentric with each other.

18. The binding safety release device of claim 11, further comprising a wall cut out formed in the rear projecting wall, wherein the wall cut out faces away from the second end.

* * * * *